US008141497B2

(12) United States Patent
Kwon et al.

(10) Patent No.: US 8,141,497 B2
(45) Date of Patent: Mar. 27, 2012

(54) SLIDING-TYPE APPARATUS FOR ABSORBING FRONT SHOCK ENERGY

(75) Inventors: Tae-Soo Kwon, Suwon (KR); Hyun-Seung Jung, Yongin (KR)

(73) Assignee: Korea Railroad Research Institute, Uiwang, Gyeonggi-Do (KR)

( * ) Notice: Subject to any disclaimer, the term of this patent is extended or adjusted under 35 U.S.C. 154(b) by 364 days.

(21) Appl. No.: 12/439,633

(22) PCT Filed: Dec. 11, 2006

(86) PCT No.: PCT/KR2006/005370

§ 371 (c)(1), (2), (4) Date: Mar. 2, 2009

(87) PCT Pub. No.: WO2008/029970

PCT Pub. Date: Mar. 13, 2008

(65) Prior Publication Data

US 2010/0026020 A1 Feb. 4, 2010

(30) Foreign Application Priority Data

Sep. 5, 2006 (KR) ..... 10-2006-0085308

(51) Int. Cl.
*B61D 15/06* (2006.01)

(52) U.S. Cl. ..... 105/392.5; 105/456; 105/342

(58) Field of Classification Search ..... 105/392.5, 105/397, 402, 410, 421, 342, 456; 213/7; 296/187.03

See application file for complete search history.

(56) References Cited

U.S. PATENT DOCUMENTS

| | | | | |
|---|---|---|---|---|
| 5,579,699 | A | 12/1996 | Dannawi et al. | |
| 6,158,356 | A | 12/2000 | Hachet et al. | |
| 6,245,408 | B1 * | 6/2001 | Bitzer | 428/118 |
| 6,561,105 | B2 * | 5/2003 | Godin et al. | 105/396 |
| 7,536,958 | B2 * | 5/2009 | Bravo et al. | 105/392.5 |
| 7,537,127 | B2 * | 5/2009 | Hogbring | 213/62 R |
| 7,708,157 | B2 * | 5/2010 | Kemper | 213/9 |
| 2010/0064931 | A1 * | 3/2010 | Heinisch et al. | 105/392.5 |

FOREIGN PATENT DOCUMENTS

JP 2002-225704 8/2002

* cited by examiner

*Primary Examiner* — S. Joseph Morano
*Assistant Examiner* — Zachary Kuhfuss
(74) *Attorney, Agent, or Firm* — IPLA P.A.; James E. Bame

(57) ABSTRACT

A sliding-type apparatus for absorbing front shock energy is disclosed. The sliding-type apparatus of the present invention includes a driver panel (130), which is provided on the front surface of a driver's cab defined by a front part protective shell (110) of a railway vehicle so as to be movable backwards, and a bottom shock absorber (150), which is provided under the lower surface of the driver panel (130). The sliding-type apparatus further includes a front shock absorber (170), which is provided on the front surface of the driver panel (130), and a driver panel shock absorber (190), which is provided at a position towards which the driver panel is moved backwards. Thus, when a railway vehicle is involved in a collision, the several shock absorbers are consecutively collapsed to efficiently absorb shock energy. Furthermore, the driver panel is moved backwards without being deformed by the shock energy. Therefore, the safety of the driver is ensured.

8 Claims, 9 Drawing Sheets

【Figure 3】
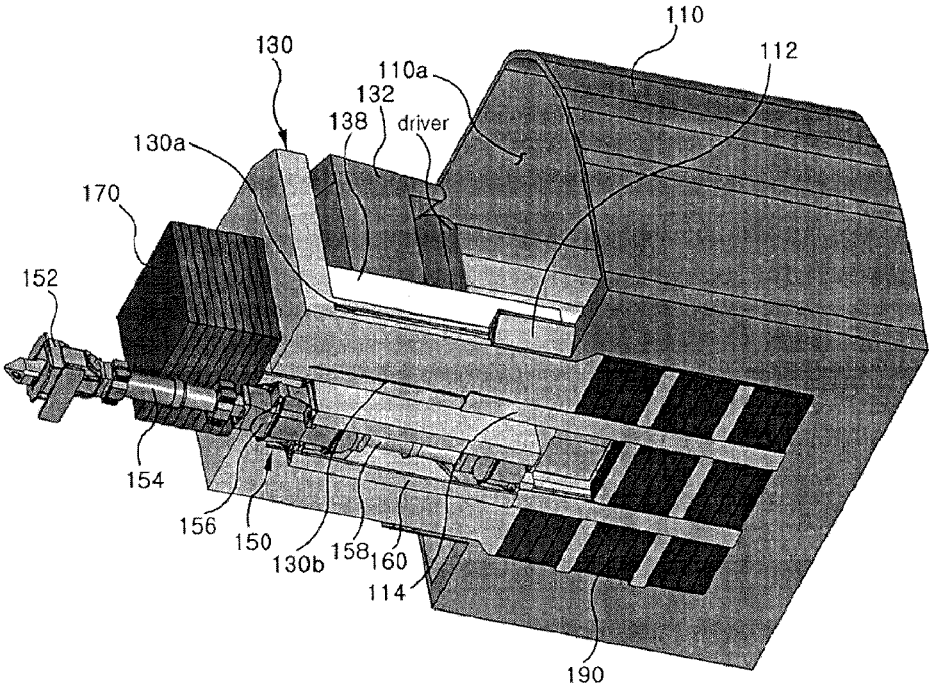
【Figure 4】
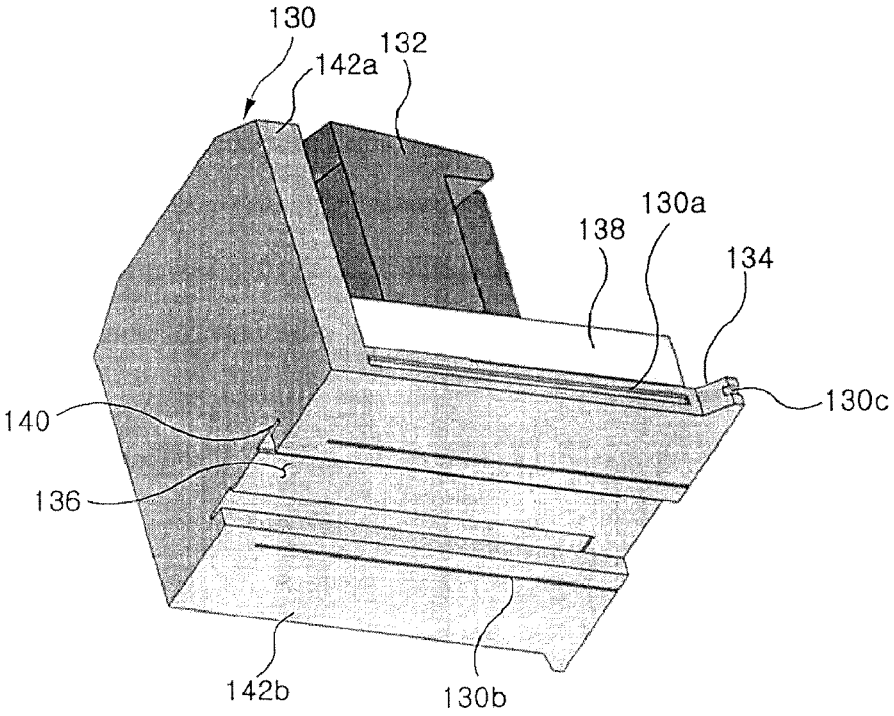

【Figure 5】
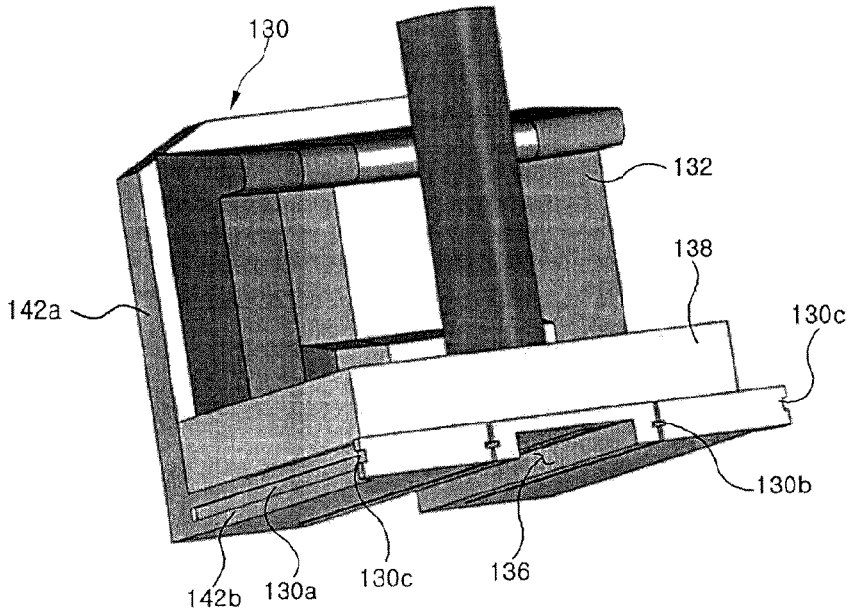
【Figure 6】
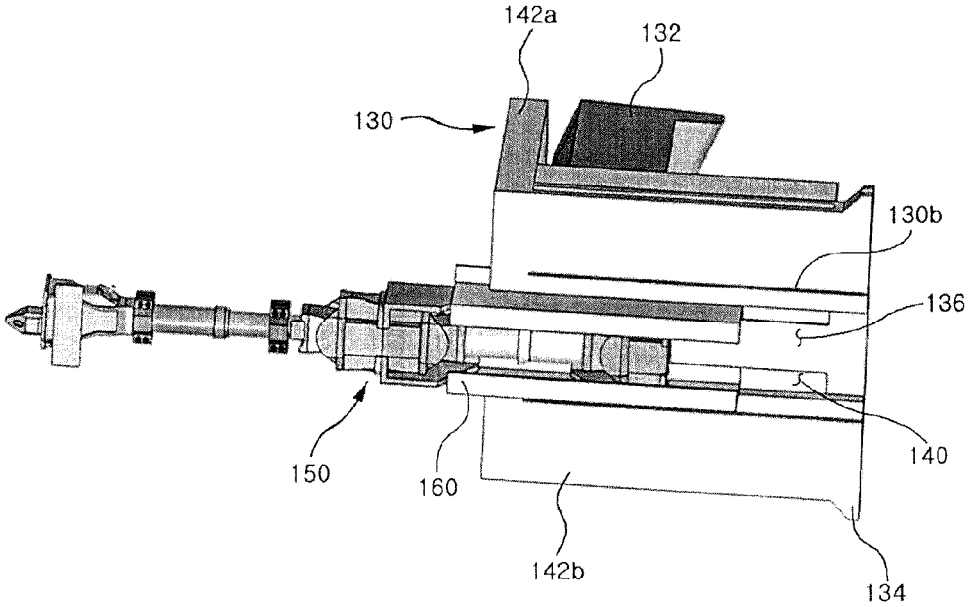

【Figure 7】
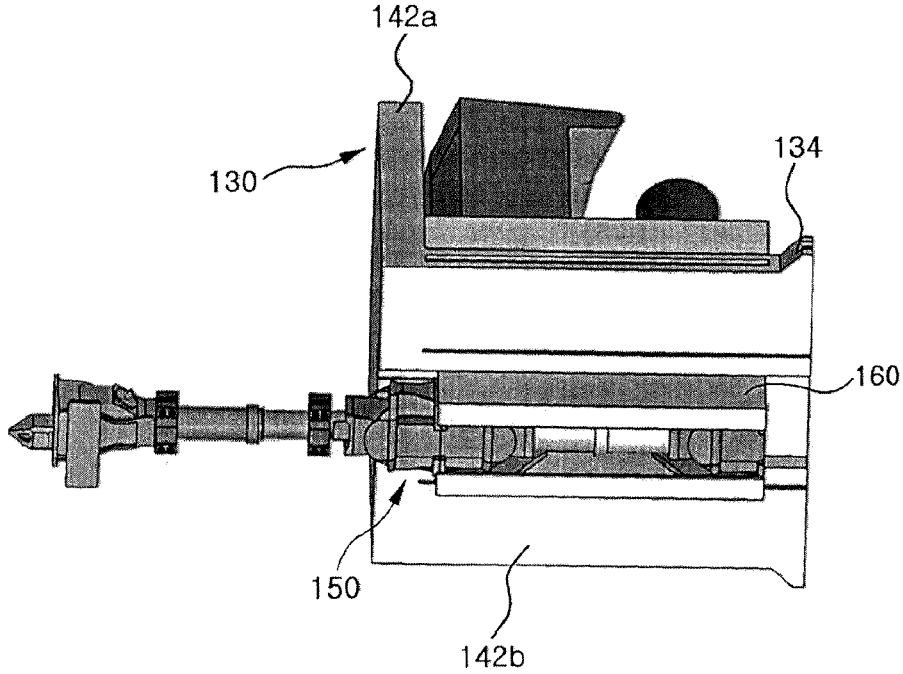
【Figure 8】
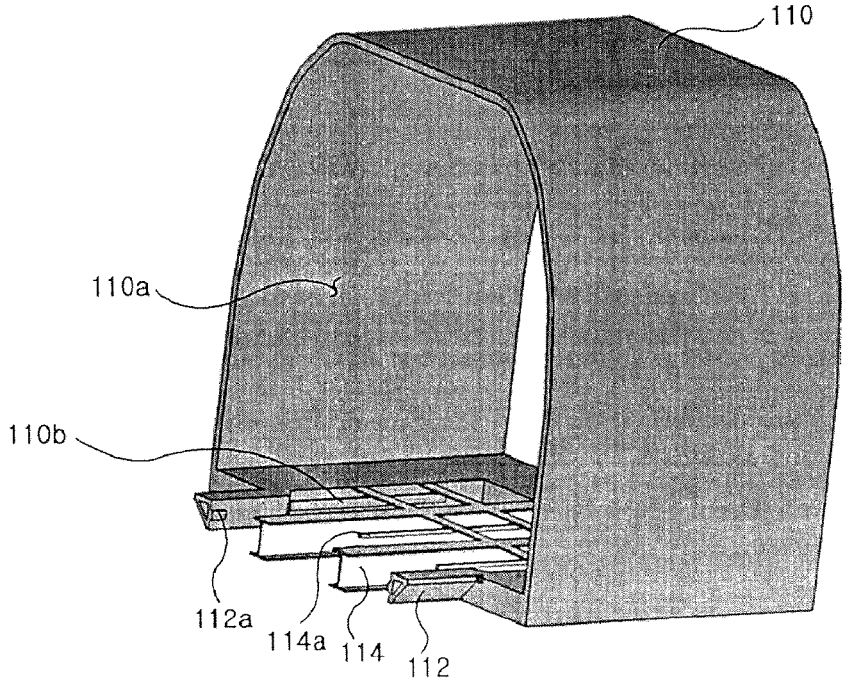

【Figure 9】
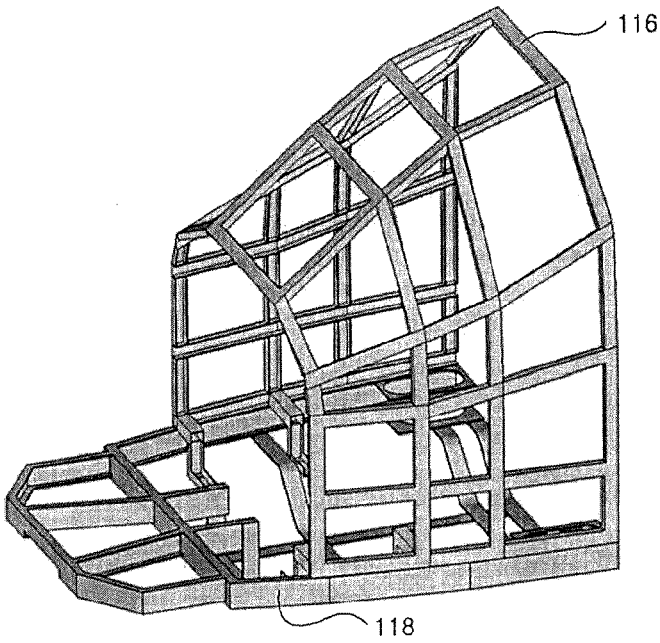
【Figure 10】
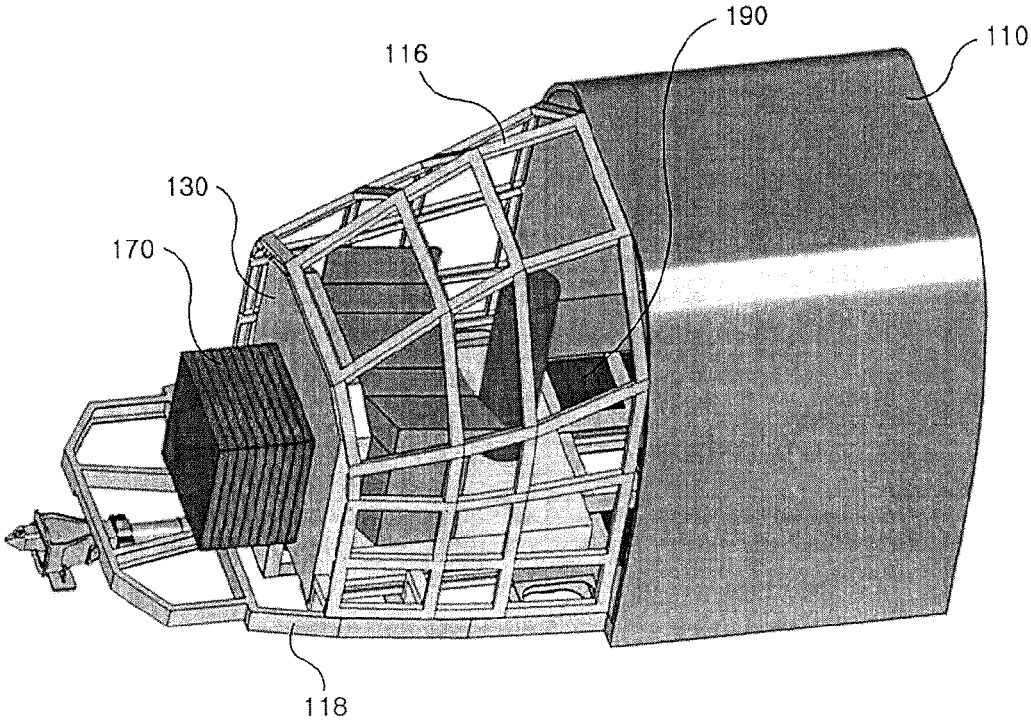

【Figure 11】
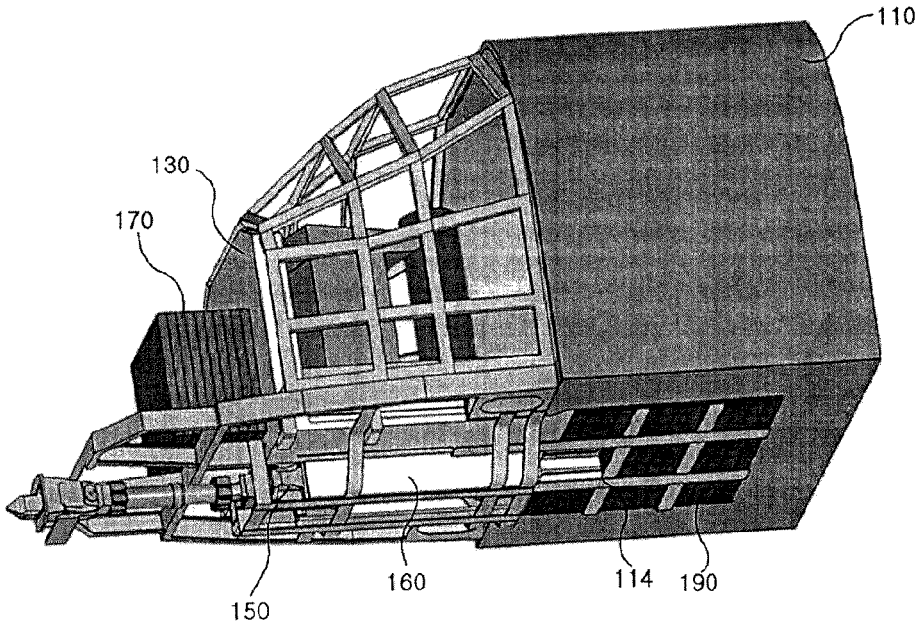
【Figure 12】
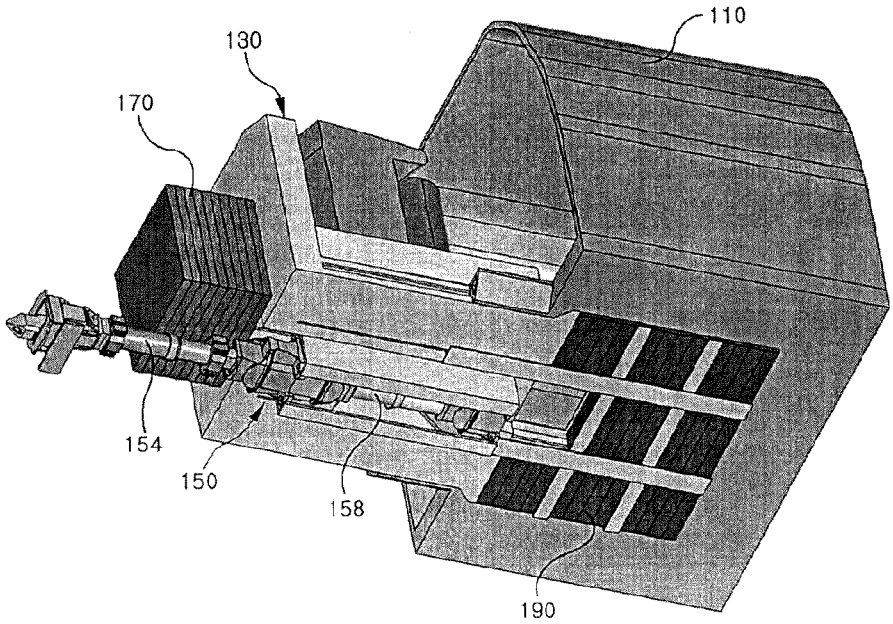

【Figure 13】
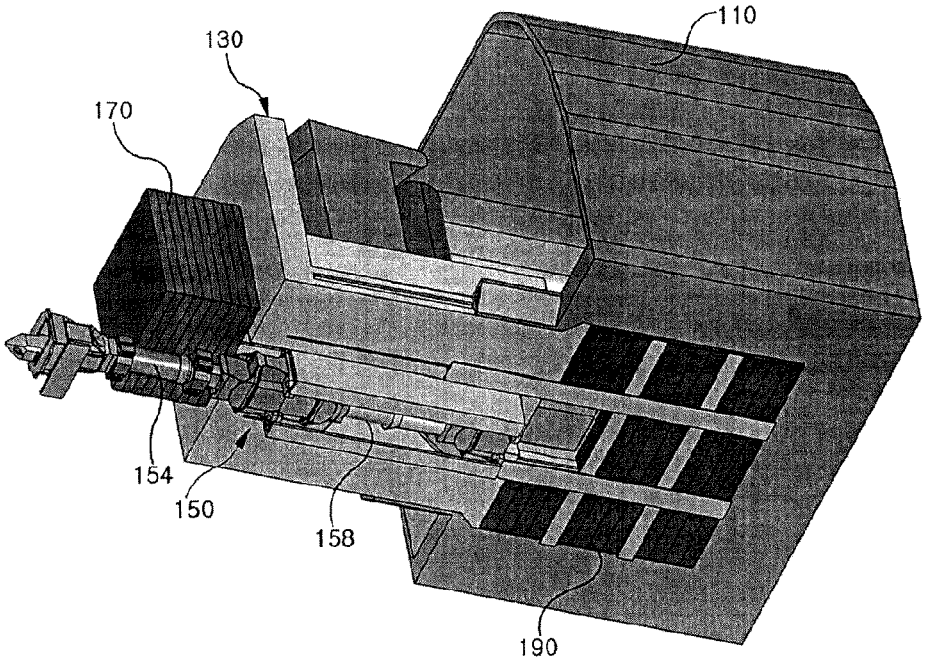
【Figure 14】
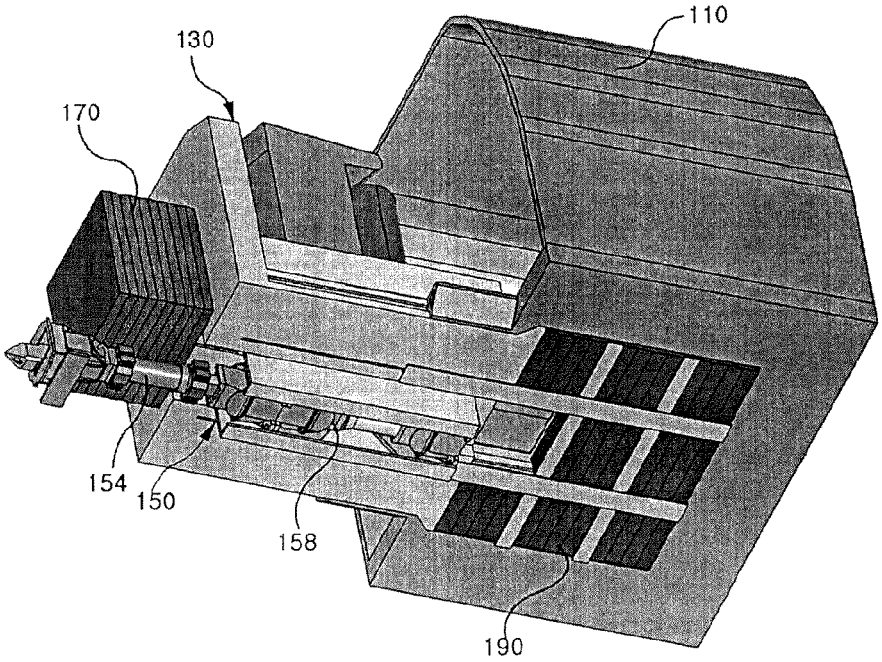

【Figure 15】
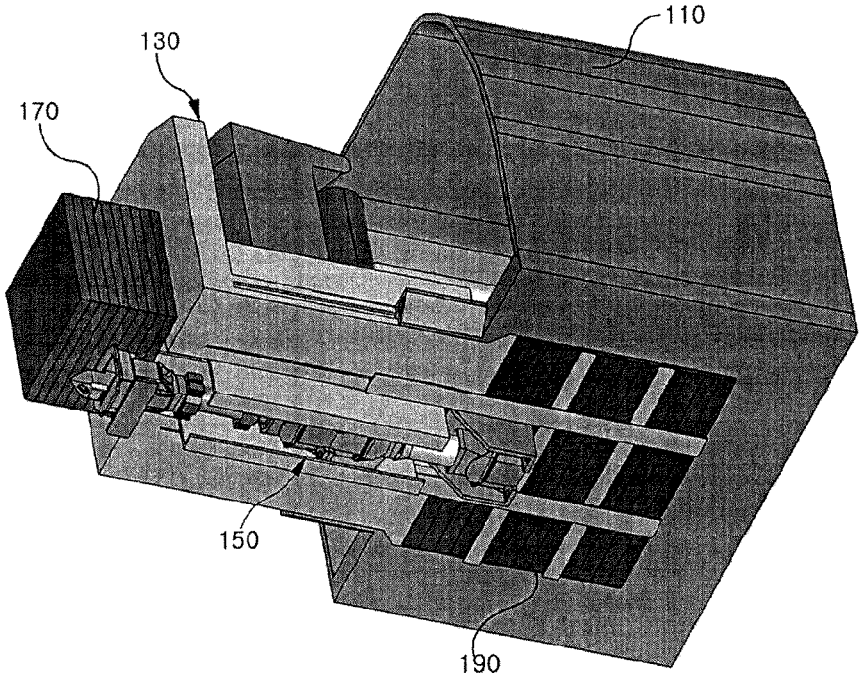
【Figure 16】
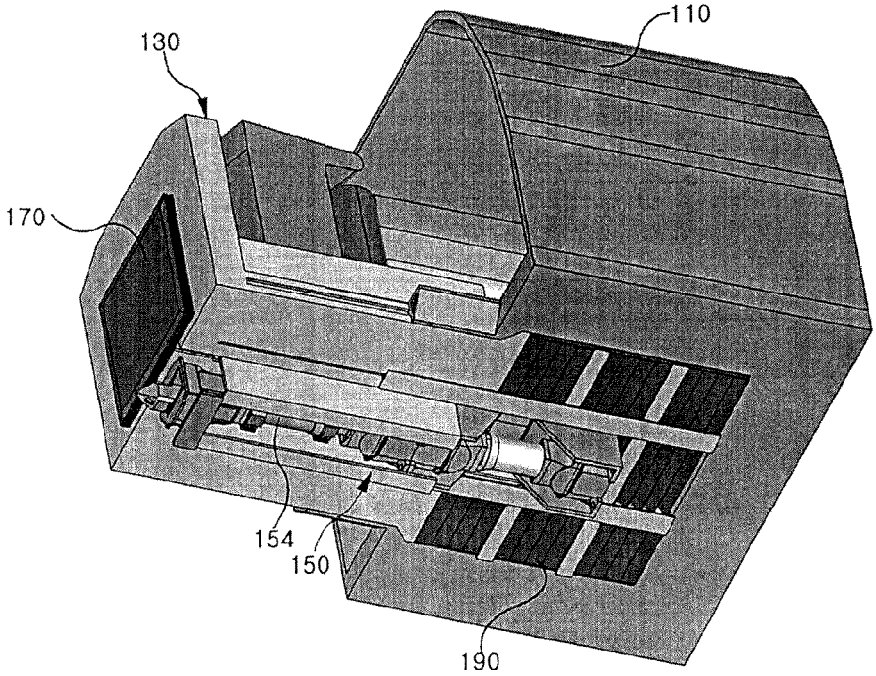

【Figure 17】
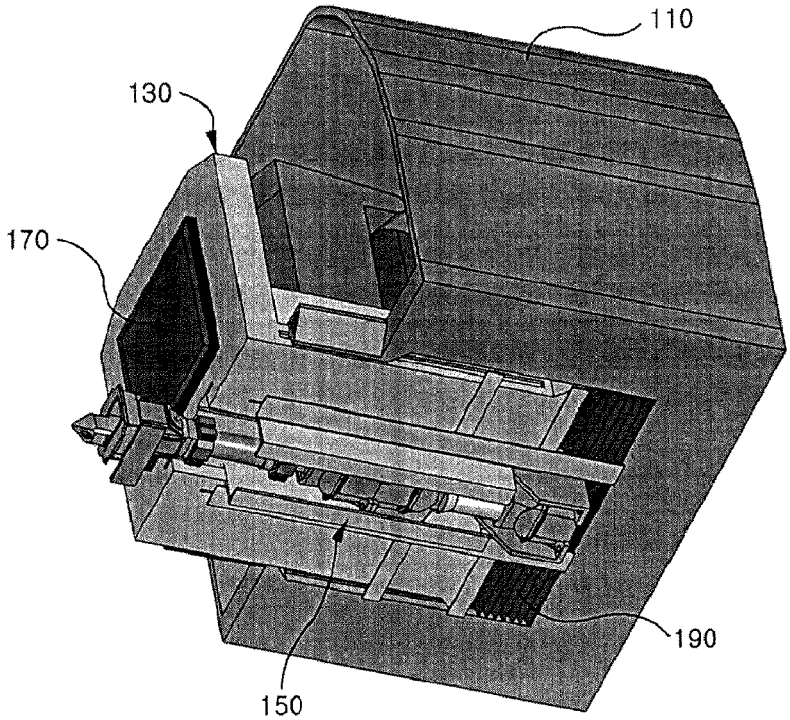

SLIDING-TYPE APPARATUS FOR ABSORBING FRONT SHOCK ENERGY

TECHNICAL FIELD

The present invention relates, in general, to sliding-type apparatuses for absorbing front shock energy, and more particularly, to a sliding-type apparatus for absorbing front shock energy which has a structure such that, when a railway vehicle is involved in a collision, the driver of the railway vehicle can be safely protected.

BACKGROUND ART

As well known to those skilled in the art, in the case of a railway vehicle which runs at a relatively high speed, a front part protrudes from the front end of the railway vehicle and absorbs shock energy when a collision occurs, thus protecting a driver and passengers. The front part is designed such that, when the railway vehicle collides with a structure, the front part can absorb 70 to 80% of the shock energy.

FIG. 1 is a conceptual view illustrating a typical apparatus for absorbing front shock energy for railway vehicles.

As shown in FIG. 1, a front part of the typical railway vehicle includes a coupler 50, a head stock 60 and a honeycomb member 70. The coupler 50 is first collapsed by shock energy, thus conducting a first shock absorbing function. The head stock 60 and the honeycomb member 70 absorb the remaining shock energy that remains after some has been absorbed by the coupler 50. Most of the shock energy is absorbed through the above process.

FIG. 2 is a schematic view illustrating a structure for absorbing shock energy for railway vehicles (proposed in Europe Patent Publication No. 0802100), which uses the concept of the above-mentioned apparatus for absorbing shock energy. This structure for absorbing shock energy for railway vehicles is an apparatus for absorbing shock energy which is installed in a front part of a railway vehicle or between passenger cars. The conventional shock energy absorbing structure for railway vehicles absorbs shock energy, generated by a collision of the railway vehicle, through a coupling 3, a casing 4, an energy absorbing buffer 7 and a shock absorber 8, thus protecting a driver and passengers.

However, the conventional shock energy absorbing structure for railway vehicles is problematic in that, when the coupling 3, the energy absorbing buffer 7, and the shock absorber 8 are collapsed by shock energy, vehicle body frames 9 and 9', which define a driver's cab therein, are also collapsed, so that the safety of the driver cannot be ensured.

DISCLOSURE

Technical Problem

Accordingly, the present invention has been made keeping in mind the above problems occurring in the prior art, and an object of the present invention is to provide a sliding-type apparatus for absorbing front shock energy which can ensure the safety of a driver when a railway vehicle is involved in a collision.

Another object of the present invention is to provide a sliding-type apparatus for absorbing front shock energy which is constructed such that, when the railway vehicle is involved in a collision, several shock absorbing devices consecutively absorb shock energy, thus effectively damping the shock energy.

A further object of the present invention is to provide a sliding-type apparatus for absorbing front shock energy in which a driver panel is provided on a front surface of a driver's cab so as to be movable backwards, so that, when the railway vehicle is involved in a collision, the driver panel is moved backwards without being deformed by the shock energy, thus reliably ensuring space for the safety of the driver.

Technical Solution

In an aspect, the present invention provides a sliding-type apparatus for absorbing front shock energy for a railway vehicle, comprising: a driver panel provided in a front part of the railway vehicle, wherein, when the shock energy is applied to the front part of the railway vehicle, the driver panel is moved backwards into a protective shell, thus absorbing the shock energy.

Preferably, the shock energy applied to the driver panel may be absorbed by a driver panel shock absorber.

In another aspect, the present invention provides a sliding-type apparatus for absorbing front shock energy for a railway vehicle, comprising: a driver panel provided on a front surface of a driver's cab in a front part of the railway vehicle so as to be movable backwards; a protective shell connected to the driver panel, so that, when the driver panel is moved backwards, the driver panel is inserted into the protective shell; a bottom shock absorber provided under a lower surface of the driver panel to absorb the shock energy; a front shock absorber provided on a front surface of the driver panel to absorb the shock energy; and a driver panel shock absorber provided at a position towards which the driver panel is moved backwards, thus absorbing the shock energy using backward movement of the driver panel.

Preferably, edge guide grooves may be formed in respective opposite edges of the driver panel, and H-beam members, which slide along the respective edge guide grooves, may be provided in the protective shell.

Furthermore, an H-beam guide slot may be formed in the driver panel, and an H-beam member may be provided in the protective shell and is slidably inserted into the H-beam guide slot.

The bottom shock absorber may include: a shock absorption tube provided in the bottom part of the driver panel; a coupler provided on a front end of the shock absorption tube and aligned with the shock absorption tube; and a draw gear connecting the coupler to the shock absorption tube.

The bottom shock absorber may further include a guide member to guide the shock absorption tube and the coupler when the shock absorption tube and the coupler are moved backwards. The front shock absorber may have a honeycomb structure.

The driver panel shock absorber may have a honeycomb structure or a structure in which tubes are arranged parallel to each other at adjacent positions.

In a further aspect, the present invention provides a sliding-type apparatus for absorbing front shock energy for a railway vehicle, wherein, when the shock energy is applied to a front part of the railway vehicle, a bottom shock absorber, a front shock absorber and a driver panel shock absorber are sequentially compressed, thus absorbing the shock energy.

Preferably, the bottom shock absorber may absorb the shock energy in a manner such that, when the shock energy is applied to a coupler head, a coupler is first compressed and a shock absorption tube is compressed.

ADVANTAGEOUS EFFECTS

As described above, a sliding-type apparatus for absorbing front shock energy according to the present invention is constructed such that, when the railway vehicle is involved in a collision, several shock absorbing devices consecutively absorb shock energy, thus effectively damping the shock energy.

Furthermore, in the present invention, a driver panel is provided on a front surface of a driver's cab so as to be movable backwards, so that, when the railway vehicle is involved in a collision, the driver panel is moved backwards without being deformed by the shock energy, thus maximally ensuring space for the safety of the driver.

DESCRIPTION OF DRAWINGS

FIG. 3 is a view of a sliding-type apparatus for absorbing front shock energy for a railway vehicle, according to the present invention;

FIGS. 4 and 5 are views of the driver panel shown in FIG. 3;

FIGS. 6 and 7 are views showing the coupling between a bottom shock absorber and the driver panel shown in FIG. 3;

FIG. 8 is a view of a protective shell shown in FIG. 3;

FIG. 9 is a view showing a body frame and an under frame, which form a front part of the railway vehicle;

FIGS. 10 and 11 are views showing installation of the body frame and the under frame shown in FIG. 9; and FIGS. 12 through 17 are views showing the operation of the sliding-type apparatus for absorbing front shock energy, according to the present invention.

BEST MODE

Figure 1:
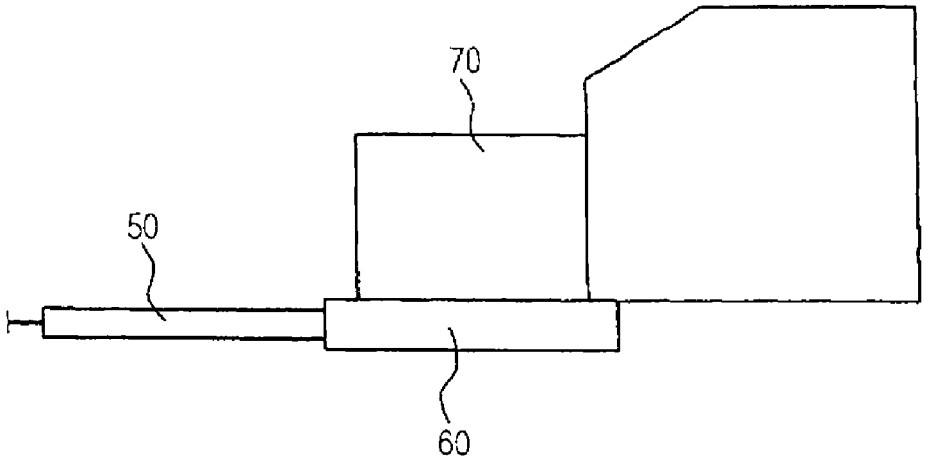
Figure 1 Prior Art
FIG. 1 is a conceptual view illustrating a typical apparatus for absorbing front shock energy for railway vehicles.
Figure 2:
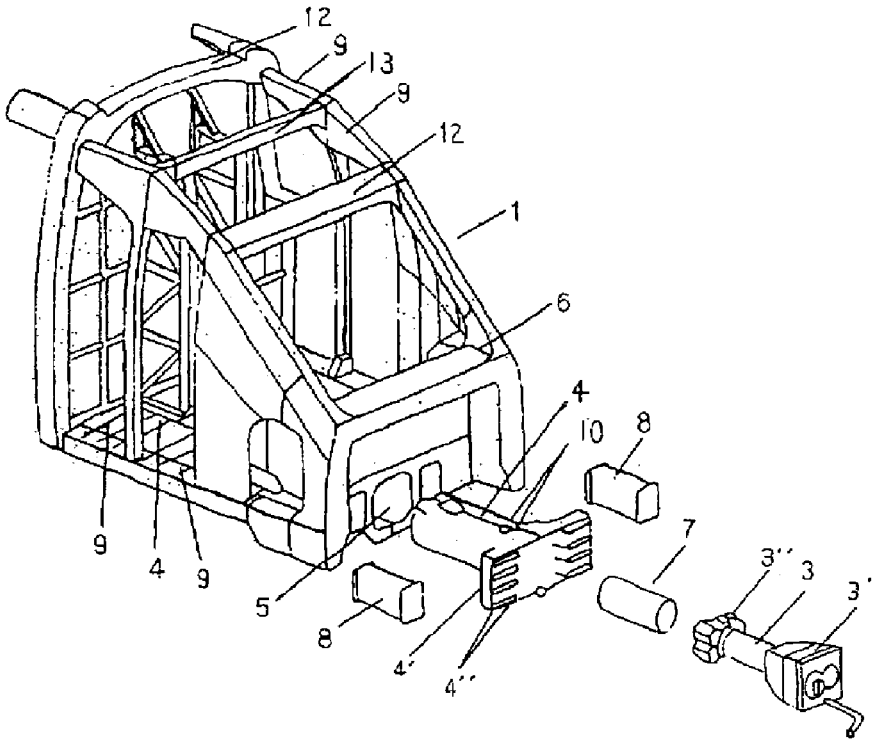
Figure 2 Prior Art
FIG. 2 is a schematic view illustrating the structure of a conventional apparatus for absorbing front shock energy for railway vehicles.

Hereinafter, a preferred embodiment of the present invention will be described in detail with reference to the attached drawings.

FIG. 3 is a view of a sliding-type apparatus for absorbing front shock energy for a railway vehicle, according to the present invention. FIGS. 4 and 5 are views of the driver panel shown in FIG. 3. FIGS. 6 and 7 are views showing the coupling between a bottom shock absorber and the driver panel shown in FIG. 3. FIG. 8 is a view of a protective shell shown in FIG. 3. FIG. 9 is a view showing a body frame and an under frame, which form a front part of the railway vehicle. FIGS. 10 and 11 are views showing the installation of the body frame and the under frame shown in FIG. 9.

As shown in FIG. 3, the sliding-type apparatus for absorbing front shock energy according to the present invention includes the driver panel 130, which is provided on a front surface of a driver's cab 110*a*, defined in a protective shell 110 of a front part of the railway vehicle, so as to be movable backwards, and the bottom shock absorber 150, which is installed under the lower surface of the driver panel 130 to absorb shock energy. The sliding-type apparatus further includes a front shock absorber 170, which is provided on a front surface of the driver panel 130 to absorb shock energy, and a driver panel shock absorber 190, which is provided at the position towards which the driver panel 130 is moved backwards, thus absorbing shock energy through the backward movement of the driver panel 130.

As shown in FIGS. 4 and 5, the driver panel 130 includes a bottom part 142*b*, which supports a support panel 138 and a control stand 132, and a front protective part 142*a*, which is bent and extended from the bottom part 142*b* to protect the front part of the driver's cab 110*a*. A bottom shock absorber mounting space 136, into which the bottom shock absorber 150 is inserted, is defined in the bottom part 142*b* of the driver panel 130. Furthermore, a guide member mounting slot 140, into which a guide member 160 is inserted to guide the bottom shock absorber 150 when it is moved backwards by shock energy, is defined in the bottom part 142*b* of the driver panel 130. That is, as shown in FIGS. 5*a* and 5*b*, the bottom shock absorber 150 and the guide member 160 are respectively inserted into and mounted to the bottom shock absorber mounting space 136 and the guide member mounting slot 140 by sliding them into the bottom part 142*b* of the driver panel 130 in one direction.

In addition, removal prevention protrusions 134 are provided on respective opposite edges of one end of the bottom part 142*b* of the driver panel 130. The removal prevention protrusions 134 serve to prevent the driver panel 130 from being undesirably removed from the protective shell 110.

As well, a first edge guide groove 130*a* and a second edge guide groove 130*c* are formed in each of the opposite edges of the bottom part 142*b* of the driver panel 130. The first edge guide grooves 130*a* and the second edge guide grooves 130*c* serve to guide the driver panel 130 such that the driver panel 130 can be moved backwards when shock energy is applied thereto. The first edge guide grooves 130*a* engage with respective first panel guide protrusions 112*a* provided on the edge guide member 112 of the protective shell 110, and the second edge guide grooves 130*c* engage with respective second panel guide protrusions 110*b* of the protective shell 110.

Furthermore, H-beam guide slots 130*b* are formed in the bottom part 142*b* of the driver panel 130. H-beam members 114, which are provided in the protective shell 110, are slidably inserted into the respective H-beam guide slots 130*b*.

Meanwhile, as shown in FIG. 8, the protective shell 110 has a dome shape and forms the external appearance of the railway vehicle. The protective shell 110 is bent inwards at opposite lower ends thereof, and edge guide members 112 are provided on the respective ends of the protective shell 110. The guide protrusions 112*a* are provided on the respective edge guide members 112, so that, when the driver panel 130 is moved backwards by shock energy, the guide protrusions 112*a* precisely guide the driver panel 130 in the backward direction.

Furthermore, the H-beam members 114 are provided in the protective shell 110. The H-beam members 114 serve both to guide the driver panel 130 when it is moved backwards and to support and prevent the driver panel shock absorber 190, which serves to absorb shock energy resulting from movement of the driver panel 130, from being removed. When shock energy resulting from the movement of the driver panel 130 is applied to the driver panel shock absorber 190, the driver panel shock absorber 190 is crushed in the longitudinal direction of the railway vehicle to absorb the shock energy while the first edge guide grooves 130*a*, which are formed in the respective opposite edges of the support panel 138 of the driver panel 130, and the second edge guide grooves 130*c*, which are formed in the removable prevention protrusions 134, are guided by the second panel guide protrusions 110*b* provided in the protective shell 110 and by shock absorber guide protrusions 114*a*, which are provided on side surfaces of the H-beam members 114. The second panel guide protrusions 110*b* of the protective shell 110 correspond to the second edge guide grooves 130*c* of the driver panel 130, and thus guide the driver panel 130.

Here, the first panel guide protrusions 112*a*, which engage with the respective first edge guide grooves 130*a* formed in the respective opposite edges of the support panel 138 of the driver panel 130, and the second panel guide protrusions 110*b*, which engage with the respective second edge guide grooves 130*c* formed in the respective removable prevention protrusions 134, are constructed such that, when the driver panel 130 is moved backwards by shock energy, frictional force can be applied thereto, thus additionally absorbing shock energy.

Meanwhile, the bottom shock absorber 150 is mounted to the bottom part 142*b* of the driver panel 130. The bottom shock absorber 150 includes a coupler head 152, a coupler 154, a shock absorption tube 158, and a rear gear 156, which connects the coupler 154 to the shock absorption tube 158.

Furthermore, when a shock is applied to the front part of the railway vehicle, for example, when the railway vehicle collides with a structure, the coupler 154 first damps the shock energy, and the shock absorption tube 158 secondarily damps the shock, the energy of which has been reduced by the coupler 154.

The coupler 154 and the shock absorption tube 158 of the bottom shock absorber 150 are coaxially coupled to each other through the rear gear 156, so that, when shock energy is applied thereto, they are moved backwards and absorb the shock energy. As such, in order to efficiently absorb shock energy using the coupler 154 and the shock absorption tube 158, the coupler 154 and the shock absorption tube 158 are constructed such that they are movable backwards, that is, in the longitudinal direction of the railway vehicle. For this, the present invention has the guide member 160, which guides the coupler 154 and the shock absorption tube 158 such that the coupler 154 and the shock absorption tube 158 are moved backwards when shock energy is applied thereto. As shown in FIGS. 6 and 7, the guide member 160 is slidably inserted into the guide member mounting hole 140, which is formed in the driver panel 130.

Meanwhile, the front shock absorber 170 is a shock absorption member having a honeycomb shape and is fastened to the front surface of the driver panel 130. The front shock absorber 170 serves to absorb some of the shock energy that is not absorbed by the bottom shock absorber 150 and thus remains.

The driver panel shock absorber 190 also has a honeycomb shape, and is provided in the lower surface of the protective shell 110 to absorb shock energy applied to the driver panel 130. The driver panel shock absorber 190 is supported by the H-beam members 114, which are provided in the protective shell 110, by the second panel guide protrusions 110*b* provided in the protective shell 110, and by the shock absorber guide protrusions 114*a* provided in the H-beam members 114.

When the driver panel 130 is moved backwards by shock energy generated in a collision, the driver panel shock absorber 190 is guided, both by the second panel guide protrusions 110*b* provided in the protective shell 110, and by the shock absorber guide protrusions 114*a* provided in the H-beam members 114, and collapses backwards while absorbing shock energy applied to the driver panel 130.

Meanwhile, as shown in FIGS. 9, 10 and 11, a body frame 116 and an under frame 118 are provided on the front end of the protective shell 110. When shock energy generated in a collision is applied to the railway vehicle, the body frame 116 and the under frame 118 are easily collapsed, thus absorbing the shock energy the moment the bottom shock absorber 150, the front shock absorber 170 and the driver panel shock absorber 190 are compressed or collapsed.

The operation of the sliding-type apparatus for absorbing front shock energy according to the present invention will be explained with reference to FIGS. 12 through 17.

FIG. 12 shows the original assembly of the driver panel 130, the bottom shock absorber 150, the front shock absorber 170 and the driver panel shock absorber 190 of the sliding-type apparatus for absorbing front shock energy according to the present invention.

In the original assembly state described above, when shock energy is applied to the front part of the railway vehicle in a collision, the shock energy is first transmitted to the coupler head 152 disposed on the front end of the bottom shock absorber 150. The shock energy, which is transmitted to the coupler head 152, is applied to the coupler 154. Then, as shown in FIG. 13, the coupler 154 is compressed by the shock energy.

Thereafter, when the coupler 154 is completely compressed by the shock energy until it can no longer be compressed, shock energy that remains is applied to the shock absorption tube 158, which is coupled to the rear end of the coupler 154. As shown in FIG. 14, the shock absorption tube 158 is compressed by the shock energy that remains after some is absorbed by the coupler 154. At this time, the shock absorption tube 158 is compressed backwards by the guide of the guide member 160.

When the coupler 154 and the shock absorption tube 158 are completely compressed until they can be compressed no more, the bottom shock absorber 150 is moved backwards along the guide member 160 by shock energy that remains, as shown in FIG. 15.

As such, the shock energy, which remains even after being absorbed by the coupler 154 and the shock absorption tube 158, moves the bottom shock absorber 150 backwards and, at a predetermined position, is applied to the front shock absorber 170, which is provided on the front surface of the driver panel 130. As shown in FIG. 16, the front shock absorber 170 is collapsed by the shock energy, thus absorbing the shock energy.

Subsequently, when the front shock absorber 170 is also completely collapsed by the shock energy, remaining shock energy is applied to the driver panel 130. Here, because the driver panel 130 is movable backwards along the edge guide members 112 of the protective shell 110, the driver panel 130 is moved backwards by the shock energy applied thereto. At this time, as shown in FIG. 17, the driver panel shock absorber 190, which has contacted the bottom part 142*b* of the driver panel 130, is collapsed by the shock energy applied to the driver panel 130, thus absorbing the shock energy.

As such, the sliding-type apparatus for absorbing front shock energy according to the present invention is constructed such that shock energy applied to the front part of the railway vehicle is absorbed in four stages. In brief, when shock energy is applied to the front part of the railway vehicle by collision, the shock energy is first absorbed by the coupler 154, which is provided on the front end of the bottom shock absorber 150. Thereafter, the shock energy is applied to the shock absorption tube 158 coupled to the rear end of the coupler 154. The shock energy that remains after the shock absorption tube 158 is completely collapsed is applied to the front shock absorber 170 provided on the front surface of the driver panel 130. The shock energy that remains even after the front shock absorber 170 is completely collapsed is finally applied to the driver panel shock absorber 190, which is installed such that it is in close contact with the bottom part of the driver panel 130. As such, most of the shock energy that is generated in a collision of the railway vehicle can be absorbed through the four stages of the shock absorption process, so that the safety of the driver of the railway vehicle is reliably ensured.

Furthermore, because it is important to prevent the driver panel 130 from being deformed during the process of absorbing shock energy generated upon a collision of the railway vehicle, the driver panel 130 must have the form of a rigid body.

As describe above, in the present invention, the driver panel is provided so as to be movable backwards, and the bottom shock absorber, the front shock absorber and the driver panel shock absorber are provided. Therefore, even if a relatively large amount of shock energy is applied to the front part of the railway vehicle, the shock energy is consecutively absorbed by the bottom shock absorber and the front shock absorber, and the remaining shock energy is absorbed by the driver panel shock absorber while the driver panel is moved backwards, thus ensuring the safety of the driver.

Although the preferred embodiment of the present invention has been disclosed for illustrative purposes, the present invention is not limited to the embodiment, and various modifications are possible without departing from the scope and spirit of the invention.

[Industrial Applicability]

As described above, the present invention provides a sliding-type apparatus for absorbing front shock energy. More particularly, the sliding-type apparatus for absorbing front shock energy according to the present invention has a structure such that, when a railway vehicle is involved in a collision, the driver of the railway vehicle can be safely protected.

The invention claimed is:

1. A sliding-type apparatus for absorbing front shock energy for a railway vehicle, comprising:

a driver panel provided on a front surface of a driver's cab in a front part of the railway vehicle so as to be movable backwards;

a protective shell connected to the driver panel, so that, when the driver panel is moved backwards, the driver panel is inserted into the protective shell;

a bottom shock absorber provided under a lower surface of the driver panel to absorb the shock energy;

a front shock absorber provided on a front surface of the driver panel to absorb the shock energy; and a driver panel shock absorber provided at a position towards which the driver panel is moved backwards, thus absorbing the shock energy using backward movement of the driver panel, wherein an H-beam guide slot is formed in the driver panel, and an H-beam member is provided in the protective shell and is slidably inserted into the H-beam guide slot.

2. The sliding-type apparatus for absorbing front shock energy according to claim 1, wherein edge guide grooves are formed in respective opposite edges of the driver panel, and edge guide members corresponding to the respective edge guide grooves are provided in the protective shell.

3. The sliding-type apparatus for absorbing front shock energy according to claim 1, wherein the bottom shock absorber comprises:

a shock absorption tube provided in the bottom part of the driver panel;

a coupler provided on a front end of the shock absorption tube and aligned with the shock absorption tube; and a draw gear connecting the coupler to the shock absorption tube.

4. The sliding-type apparatus for absorbing front shock energy according to claim 1, wherein the bottom shock absorber further comprises a guide member to guide the shock absorption tube and the coupler when the shock absorption tube and the coupler are moved backwards.

5. The sliding-type apparatus for absorbing front shock energy according to claim 1, wherein the front shock absorber has a honeycomb structure.

6. The sliding-type apparatus for absorbing front shock energy according to claim 1, wherein the driver panel shock absorber has a honeycomb structure or a structure in which tubes are arranged parallel to each other at adjacent positions.

7. The sliding-type apparatus for absorbing front shock energy according to claim 2, wherein an H-beam guide slot is formed in the driver panel, and an H-beam member is provided in the protective shell and is slidably inserted into the H-beam guide slot.

8. The sliding-type apparatus for absorbing front shock energy according to claim 3, wherein the bottom shock absorber further comprises a guide member to guide the shock absorption tube and the coupler when the shock absorption tube and the coupler are moved backwards.

* * * * *